US006925417B2

(12) United States Patent
Sasaguri

(10) Patent No.: US 6,925,417 B2
(45) Date of Patent: Aug. 2, 2005

(54) METHOD OF PREDICTING ESTRUS AND DELIVERY DATE OF COW, SWINE, HORSE OR THE LIKE BY ANALYSIS OF FREQUENCY VALUES AND DISCOVERING DISEASE OF COW, SWINE, HORSE OR THE LIKE, AS WELL AS ATTACHABLE APPARATUS FOR PREDICTING ESTRUS AND DELIVERY DATE AND DISCOVERING DISEASE, WHICH IS USED FOR SUCH METHOD

(76) Inventor: Kouji Sasaguri, 2-31-27 Tukimigaoka, Miyazaki City, Miyazaki-Prefecture (JP)

( * ) Notice: Subject to any disclaimer, the term of this patent is extended or adjusted under 35 U.S.C. 154(b) by 27 days.

(21) Appl. No.: 10/614,039

(22) Filed: Jul. 8, 2003

(65) Prior Publication Data

US 2005/0021295 A1 Jan. 27, 2005

(51) Int. Cl.[7] ..... G21C 17/00
(52) U.S. Cl. ..... 702/183; 119/174
(58) Field of Search ..... 702/183; 119/174

(56) References Cited

U.S. PATENT DOCUMENTS 4,686,103 A * 8/1987 Anderson ..... 514/2
4,869,260 A * 9/1989 Young et al. ..... 600/545
5,111,799 A * 5/1992 Senger et al. ..... 600/551
5,542,431 A * 8/1996 Starzl et al. ..... 600/551
5,881,673 A * 3/1999 Beach et al. ..... 119/174
6,236,318 B1 * 5/2001 Yang et al. ..... 340/573.3
6,342,041 B1 * 1/2002 Saint-Ramon et al. ..... 600/551
6,467,430 B1 * 10/2002 Stampe ..... 119/174
6,708,648 B2 * 3/2004 Stampe ..... 119/174
2002/0010390 A1 * 1/2002 Guice et al. ..... 600/300
2005/0012623 A1 * 1/2005 Jackson et al. ..... 340/573.3

FOREIGN PATENT DOCUMENTS

JP 2001208602 A * 8/2001 ..... G01H/1/00

* cited by examiner

*Primary Examiner*—Patrick Assouad
*Assistant Examiner*—Anthony Gutierrez
(74) *Attorney, Agent, or Firm*—Armstrong, Kratz, Quintos, Hanson & Brooks, LLP

(57) ABSTRACT

A method and apparatus for predicting the estrus and the delivery date of a cow, a swine, a horse or the like and discovering diseases such as fasciolisasis and ovarian tumor thereof by analysis of values from an attachable vibrograph attached to a leg portion, a neck portion, a chin portion or the like of the cow, the swine, the horse or the like to obtain frequency value information, such as vibrations, walking states and non-walking states, due to the excitement of the cow, the swine, the horse or the like caused by estrus. The obtained frequency value information is transmitted, inputted and stored into a centralized computer such as a personal computer in units of hours, and the stored frequency value information is converted to the numerical values to be analyzed.

2 Claims, 2 Drawing Sheets

METHOD OF PREDICTING ESTRUS AND DELIVERY DATE OF COW, SWINE, HORSE OR THE LIKE BY ANALYSIS OF FREQUENCY VALUES AND DISCOVERING DISEASE OF COW, SWINE, HORSE OR THE LIKE, AS WELL AS ATTACHABLE APPARATUS FOR PREDICTING ESTRUS AND DELIVERY DATE AND DISCOVERING DISEASE, WHICH IS USED FOR SUCH METHOD

BACKGROUND OF THE INVENTION

1. Field of the Invention

The present invention relates to a method of predicting the estrus and the delivery date of a cow, a swine, a horse or the like and discovering diseases of the cow, the swine, the horse or the like through functions such as an estrus predicting function, a delivery date predicting function and a disease discovering function for the cow, the swine, the horse or the like by analysis of values from an attachable vibrograph attached to a leg portion, a neck portion, a chin portion or the like of the cow, the swine, the horse or the like to obtain frequency value information, such as vibrations, walking states and non-walking states, due to the excitement of the cow, the swine, the horse or the like caused by estrus. The obtained frequency value information is transmitted, input and stored into a centralized computer such as a personal computer in units of hours, and the stored frequency value information is converted to the numerical values to be analyzed. The present invention also relates to an attachable apparatus for predicting estrus and d livery dates and discovering diseases, which is used for such method.

2. Description of the Related Art

Conventional methods of predicting the estrus and the delivery dates of cows, swine, horses or the like as well as methods of discovering diseases of cows, swine, horses or the like have often depended on the intuition of breeders or made it necessary to ask diagnosis of expert veterinarians or inseminators, so that these methods have been inefficient and often too late. Recently, a method has been adopted which is used only in dairy for the purpose of detecting the estrus of a cow by reading the number of steps taken by a cow through a sensor attached to the gate of a milking parlor when the cow is guided to the milking parlor. However, this method has the disadvantages that a large-sized apparatus is needed and that the total number of steps taken by a cow from one milking period until the next milking period can only be counted and no accurate time of starting of estrus can be obtained, so that no high conception rate can be achieved. It has, therefore, been necessary to ameliorate these disadvantages. In addition, since only dairy cows pass through the gate, it has been impossible to discover the estrus of other kinds of cows such as Japanese cows, Holstein cows and breeding cows.

In foreign countries, when the milk temperature of a cow lowers from an usual temperature of approximately 39° C. during milking, it is determined that the cow is in estrus, and preparation for insemination is started. However, because this decision is made on the basis of the time when the milk temperature begins lowering, the cow may not be able to be inseminated before it is too late.

SUMMARY OF THE INVENTION

The invention provides a method of predicting the estrus and the delivery date of a cow, a swine, a horse or the like and discovering diseases such as fasciolisasis and ovarian tumor thereof by analysis of values from an attachable vibrograph attached to a leg portion, a neck portion, a chin portion or the like of the cow, the swine, the horse or the like to obtain frequency value information, such as vibrations, walking states and non-walking states, due to the excitement of the cow, the swine, the horse or the like caused by estrus. The obtained frequency value information is transmitted, inputted and stored into a centralized computer such as a personal computer in units of hours, and the stored frequency value information is converted to the numerical values to be analyzed. The invention also provides an apparatus which is used for such method. It has been necessary to develop an accurate predicting method and apparatus capable of solving inefficiency and inaccuracy which are problems found in the conventional predicting and discovery methods and of realizing simple prediction and diagnosis. The invention has been made to solve the disadvantages of the related art, and provides a method of accurately predicting the estrus and the delivery date of a cow, a swine, a horse or the like by analysis of frequency values and a method of facilitating the discovery of diseases.

BRIEF DESCRIPTION OF THE DRAWINGS

The invention will become more readily appreciated and understood from the following detailed description of a preferred embodiment of the invention when taken in conjunction with the accompanying drawings, in which.

DETAILED DESCRIPTION OF THE INVENTION

Figure 1:
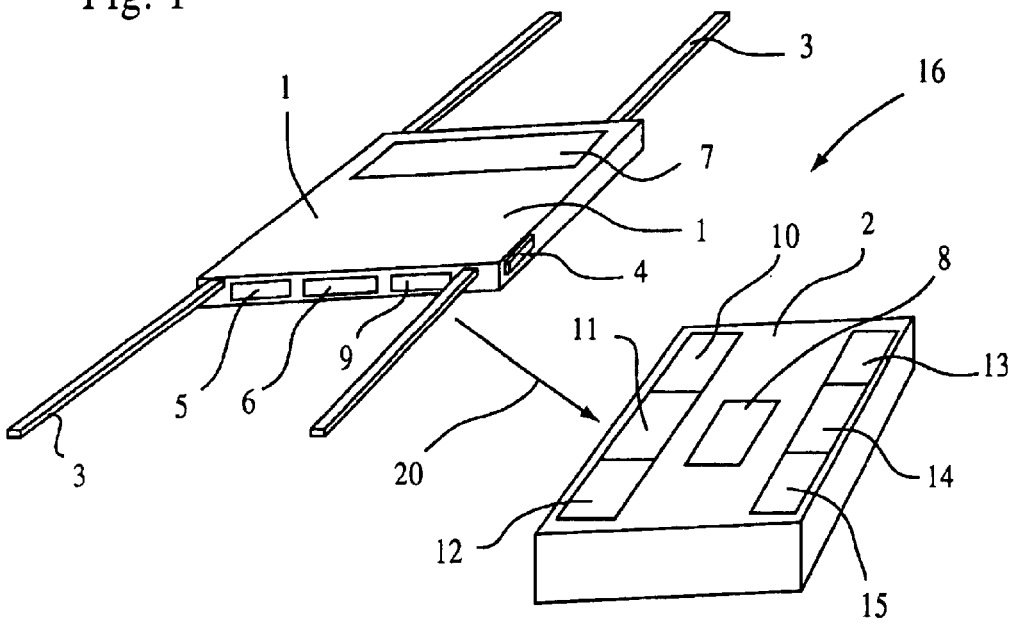
FIG. 1 is a schematic view of an attachable apparatus for predicting estrus and delivery dates and discovering diseases according to the invention.
Figure 2:
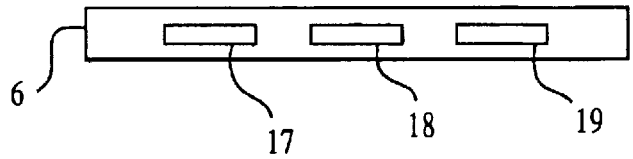
FIG. 2 is a block diagram of a vibration measuring part and the frequency values contained therein.

A method of predicting the estrus and the delivery date of a cow, a swine, a horse or the like by analysis of frequency values and a method of facilitating the discovery of diseases will be described below in detail with reference to the accompanying drawings. An attachable vibrograph 1 is attached to a leg portion, a neck portion, a chin portion or the like of a cow, a swine, a horse or the like by an attaching strap 3, and the attachable vibrograph 1 is activated by the operation of an activating switch 4 attached to the attachable vibrograph 1. The attachable vibrograph 1 is driven by a battery 5 included in the attachable vibrograph 1, and the stage of charge of the battery 5 is constantly checked to recharge the battery.

When the attachable vibrograph 1 is driven by the operation of the activating switch 4, an intermittent-vibration frequency value 17, a continuous-vibration frequency value 189, a static-vibration or non-vibration frequency value 19 and the like are generated, and these pieces of frequency value information are transmitted and inputted to a centralized computer. The inputted pieces of frequency value information are stored in the centralized computer and are represented in the form of a graph such as a bar graph or a line graph by the centralized computer, and are also displayed on a display 7 of the attachable vibrograph 1.

The inventor has discovered that the intermittent-vibration frequency value 17 is generated by the excitement of a cow, a swine, a horse or the like during estrus and when the cow, the swine, the horse or the like is in estrus, a vibration occurs intermittently. In the experiment conducted from Apr. 1, 2002 until the 14th day on which one of two 14-month-old bred cows was recognized to come into estrus, the two 14-month-old bred cows which took an average of 2,000 to 3,000 steps for one day were accommodated into a free stall in one paddock and were subjected to testing. The testing showed that the one of the cows suddenly increased its number of steps to a recorded frequency value of 357 on April 10 at 2 p.m., which was 10 days after the test was started, and reached a peak of 497 steps per hour at 12 a.m. on April 11. The number of steps taken by the cow was 3.45 times the number of steps taken by the other which was only 144 in the same stall at the same instant of time. The total number of steps taken by the cow on April 10 was 6,046, and the symptom of estrus of the cow continued for 6 hours. After that, the number of steps of the cow began to decrease, and the cow made no movement at all for 1 hour. On the next day, the state of the cow was diagnosed as true estrus by rectal examination, and the cow was inseminated at 4 p.m.

Figure 3:
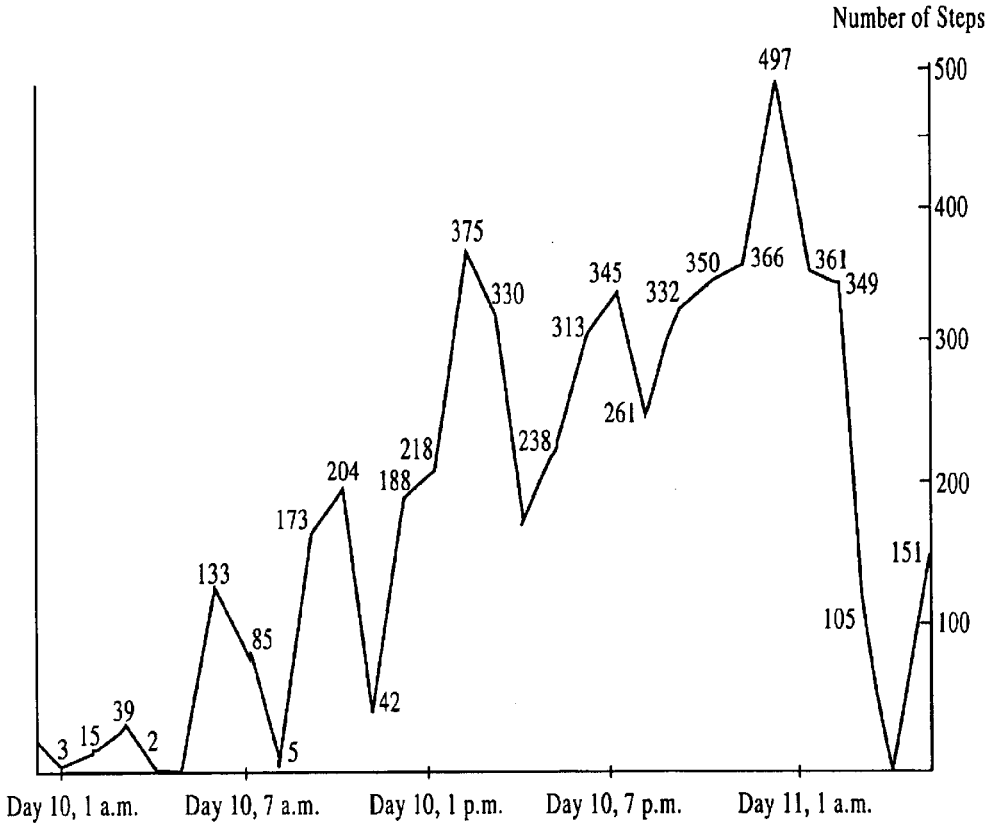
FIG. 3 shows a set of partial estrus data obtained during different time zones as to a 14-month-old bred cow.

As specifically shown in FIG. 3 which represents the movement of the 14-month-old bred cow as a set of partial estrus data obtained during different time zones, the movement of the cow on April 10 was observed as follows: although the cow had not made many steps since the last night before, the cow took 3 steps at 1 a.m., and the number of steps of the cow continued to increase for 2 hours from 15 steps at 2 a.m. to 39 steps at 3 a.m. After that, the number of steps decreased from 2 at 4 a.m. to 0 at 5 a.m., but sharply increased to 133 at 6 a.m., and again decreased to 85 at 7 a.m. and further to 5 at 8 a.m. After that, the number of steps continued to increase for 2 hours from 173 at 9 a.m. to 204 at 10 a.m., and again decreased to 42 at 11 a.m.

Because the cow was made to take exercise in an exercise field as usual around 12 p.m., the number of steps taken by the cow increased sharply to 198 at 12 p.m., and continued to increase for 3 hours to 218 at 1 p.m. and to 375 at 2 p.m. After that, the number of steps decreased to 330 at 3 p.m. and to 176 at 4 p.m. within a high range, and again continued to increase sharply for 3 hours to 233 at 5 p.m., to 313 at 6 p.m., and to 345 at 7 p.m. After that, the number of steps decreased to 261 at 8 p.m.

The number of steps, however, continued to increase sharply for 4 hours to 332 at 9 p.m., to 350 at 10 p.m., to 366 at 11 p.m., and to 497 at 12 p.m. then, the number of steps began to decrease, and the cow made no movement at all for 1 hour. On the next day, the state of the cow was diagnosed as true estrus by rectal examination, and the cow was inseminated at 4 p.m.

The estrus of the cow was easy to discover, particularly because these time zones were midnight and the number of steps per hour was ordinarily not greater than 30.

In addition, a 6-year-old dairy cow which had delivered 40 days ago and was scheduled to be slaughtered was tested in a tethered state. Because the cow was bred in a tethered state, the number of steps taken by the cow was generally as small as 150 steps or less at most per hour, compared to cows bred in a free stall. The cow made movements similar to those of other young cows in the exercise field. The symptom of estrus of the cow was discovered owing to the fact that an average of 116 steps were discovered for 3 hours from 4 p.m. until 6 p.m. on April 10 which was 10 days later, and as the result of rectal examination on the morning of the next day, the state of the cow was diagnosed as a state in which a symptom of estrus began to appear but did not yet reach its complete state.

An average of 134 steps per hour continued for 3 hours from 4 p.m. until 6 p.m. on April 12, the next day of the examination, similarly to the previous day, and as the result of examination on the following day, the state of the cow was diagnosed as true estrus, and the cow was inseminated at 10 a.m. on the 13th.

However, it is difficult to discover the estrus of a cow which has experienced a larger number of deliveries in a tether state, and great care needs to be taken in determining the number of steps taken by such a cow.

On fine days, all the heads are made to take exercise in the exercise field from 1 p.m. until about 3 p.m., and during this time, the continuous-vibration frequency value 18 is generated. The cows, swine, horses or the like are made to move to the exercise field and take exercise such as walking in the exercise field, whereby the continuous-vibration frequency value 18 is generated.

During a static-vibration or non-vibration state such as sleeping, the static-vibration or non-vibration frequency value 19 appears. Vibrations including fine vibrations are accurately inputted to a vibration measuring part 6 of the attachable vibrograph 1 as frequency value information, and the frequency value information inputted to the vibration measuring part 6 of the attachable vibrograph 1 is constantly wirelessly transmitted to a receiving function 10 of a centralized computer 2 remote from the attachable vibrograph 1 via a transmission function 9 in the attachable vibrograph 1.

The frequency value information transmitted to the receiving function 10 of the centralized computer 2 is stored in a storage function 8, and the frequency value information stored in the storage function 8 is represented in the form of a graph such as a bar graph or a line graph in units of hours by a graphics function 11 included in the centralized computer 2. The time of estrus, the date of delivery and the symptom of a disease or the like of each of the cows, the swine, the horse or the like are analyzed with the graph such as a bar graph or a line graph by an analysis function 12. On the basis of the analysis contents analyzed by the analysis function 12, the time of estrus of each of the cows, the swine, the horses or the like is predicted by an estrus predicting function 13 included in the centralized computer 2, and the date of delivery after insemination of each of the cows, the swine, the horses or the like is predicted by a delivery date predicting function 14 included in the centralized computer 2, and further, a disease of each of the cows, the swine, the horses or the like is discovered by a disease discovering function 15 included in the centralized computer 2.

The invention was tested in a dairy farm in which 50 heads were bred in tethered states, and it was proved that the estrus of a dairy cow which had experienced a large number of deliveries was difficult to discover in tethered breeding compared to free breeding. However, according to the invention, it was proved that the estrus of even such a dairy cow was able to be discovered by carefully observing the number of steps taken by the dairy cow. Particularly in free breeding, estrus was able to be discovered with a probability of 100%.

An apparatus according to the invention, which is used for the method of predicting the estrus and the delivery date of a cow, a swine, a horse or the like by analysis of frequency values and the method of facilitating the discovery of diseases, will be described in detail with reference to the accompanying drawings. The apparatus includes the attachable vibrograph 1 and the centralized computer 2 . The attachable vibrograph 1 includes the attaching strap 3 for attaching the attachable vibrograph 1 to a leg portion, a neck portion, a chin portion or the like of a target animal such as a cow, a swine or a horse, the activating switch 4, the display 7, and also includes in the interior of the apparatus the battery 5 for driving the apparatus, the vibration measuring part 6 for measuring frequency values such as the intermittent-vibration frequency value 17, the continuous-vibration frequency value 18 and the static-vibration or non-vibration frequency value 19, and the transmission function 9 for transmitting frequency value information including fine vibration information to the centralized computer 2 remote from the attachable vibrograph 1 by wireless transmission 20. The centralized computer 2 receives the frequency value information constantly transmitted from the vibration measuring part 6 of the attachable vibrograph 1.

The centralized computer 2 includes in a built-in form the receiving function 10 for receiving the frequency value information transmitted from the vibration measuring part 6 of the attachable vibrograph 1, the storage function 8 for storing the transmitted frequency value information, a graphics function 11 for providing a graphic representation of the frequency value information received by the receiving function 10 and stored in the storage function 8, the analysis function 12 for analyzing a graph, such as a bar graph or a line graph, represented by the graphics function 11, the estrus predicting function 13 for predicting the estrus of the cow, the swine, the horse or the like analyzed by the analysis function 12, the delivery date predicting function 14, and the disease discovering function 15 .

The invention has been developed exclusively for dairying, and is constructed to continue transmitting frequency value information to the centralized computer 2 such as a personal computer by the wireless transmission 20 for 24 hours in units of hours.

Accordingly, it is possible to discover the time of starting of estrus, the peak time of estrus, and the time of ending of estrus, and it is also possible to accurately determine an instant of time for insemination.

In addition, it is possible to detect accurately in real time the number of steps taken by a cow which is not being milked, where by it is possible to easily detect the estrus of a cow which is being pastured, a cow bred in a tethered state, a breeding cow, a black Japanese cow or the like Another feature of the invention resides in the disease discovering function 15. For example, in the case of cows, it is possible to easily discover diseases such as fasciolisasis and ovarian tumor.

Referring to cows from among cows, swine and horses by way of example, there are various cow diseases, and the most prevalent disease is fasciolisasis. Fasciolisasis is caused by a parasite of the kind called fasciola species which are parasitic on the liver, and it has been reported that a sharp decrease occurs in the amount of milk obtained from a cow affected by fasciolisasis. Ovarian tumors are known as the second most prevalent disease. Well-known forms of ovarian tumors are tumors occurring in the epithelium of an ovary and tumors which metastasize from the stomach, the intestines and a mammary gland.

In the case of diseases such as fasciolisasis and ovarian tumors, a large variation is found in frequency value information in units of hours on a cow affected by such a disease. Namely, it has been found that the number of step taken by the affected cow increases compared to the ordinary state of the cow.

According to the invention, it is not only possible to solve the disadvantage of the related art, but it is also possible to achieve the following advantage. Namely, frequency value information, such as vibrations, walking states and non-walking states, obtained from the excitement of a cow, a swine, a horse or the like during estrus is transmitted, inputted, and stored into a centralized computer, and the stored frequency value information is converted to numerical values, whereby the estrus and the delivery date of the cow, the swine, the horse or the like can be predicted through the analysis of the numerical values, by the above-described functions for the cow, the swine, the horse or the like, such as the estrus predicting function, the delivery date predicting function and the disease discovering function. In addition, it is possible to discover diseases.

The invention has been developed exclusively for dairying, and is constructed to continue transmitting frequency value information to a centralized computer such as a personal computer by wireless transmission for 24 hours in units of hours. Accordingly, it is possible to discover the time of starting of estrus, the peak time of estrus, and the time of ending of estrus, and it is also possible to accurately determine an instant of time for insemination.

In addition, it is possible to detect accurately in real time the number of steps taken by a cow which is not being milked, whereby it is possible to easily detect the estrus of a cow which is being pastured, a cow bred in a tethered state, a breeding cow, a black Japanese cow or the like.

Furthermore, since the apparatus has the disease discovering function, it is possible to easily discover diseases such as fasciolisasis and ovarian tumor, for example, in the case of cows.

What is claimed is:

1. A method of predicting the estrus and the delivery date of a cow, a swine, or a horse by analysis of frequency values and discovering diseases, comprising the steps of:

attaching an attachable vibrograph to a leg portion, a neck portion, or a chin portion of the cow, a swine, or a horse;

accurately inputting frequency values inclusive of fine vibration frequency values into a vibration measuring part of the attachable vibrograph, the frequency values including an intermittent-vibration frequency value generated by theexcitement of the cow, the swine, the horse during estrus, a continuous-vibration frequency value based on walking or exercise, and a static-vibration or non-vibration frequency value indicative of a static-vibration or non-vibration state such as sleeping;

constantly wirelessly transmitting the frequency value information inputted into the vibration measuring part of the attachable vibrograph to a remote centralized computer by a transmission function, inputting the transmitted frequency value information to the centralized computer, and storing the transmitted frequency value information in a storage function;

representing the frequency value information stored in the storage function in the form of a graph such as a bar graph or a line graph in units of hours by a graphics function included in the centralized computer;

analyzing the time of estrus, the date of delivery and the symptom of a disease of the cow, the swine, or the horse with the graph such as a bar graph or a line graph by means of an analysis function; and on the basis of analysis contents analyzed by the analysis function, predicting the time of estrus of the cow, the swine, or the horse by an estrus predicting function included in the centralized computer, and predicting the date of delivery after insemination of the cow, the swine, or the horse by a delivery date predicting function included in the centralized computer, and further, discovering a disease of the cow, the swine, or the horse by a disease discovering function included in the centralized computer.

2. An attachable apparatus for predicting estrus and a delivery date and discovering a disease, which is used for a method of predicting the estrus and the delivery date of a cow, a swine, or a horse and discovering a disease of the cow, the swine, or the horse, comprising:

an attachable vibrograph including:

an attaching strap for attaching the attachable vibrograph to a leg portion, a neck portion, or a chin portion of the cow, the swine, or the horse; an activating switch; and a display, and also including in the interior of the attachable vibrograph: a battery for driving the attachable apparatus; and a vibration measuring part for measuring frequency values such as an intermittent-vibration frequency value, a continuous-vibration frequency value and a static-vibration or non-vibration frequency value; and a transmission function for transmitting frequency value information including fine vibration information to a remote centralized computer by wireless transmission in units of hours; and the centralized computer for receiving the frequency value information constantly transmitted from the vibration measuring part of the attachable vibrograph, the centralized computer including in a built-in form: a receiving function for receiving the frequency value information transmitted from the vibration measuring part of the attachable vibrograph; a storage function for storing the transmitted frequency value information; a graphics function for providing a graphic representation of the frequency value information received by the receiving function; an analysis function for analyzing a graph, such as a bar graph or a line graph, represented by the graphics function; an estrus predicting function for predicting the estrus of the cow, the swine, or the horse analyzed by the analysis function; a delivery date predicting function; and a disease discovering function.

* * * * *